US009649843B2

(12) United States Patent
Imai et al.

(10) Patent No.: US 9,649,843 B2
(45) **Date of Patent: *May 16, 2017**

(54) INK-JET RECORDING APPARATUS AND ACCUMULATION SUPPRESSING METHOD

(71) Applicant: Brother Kogyo Kabushiki Kaisha, Nagoya-shi, Aichi-ken (JP)

(72) Inventors: Kenjiro Imai, Toyohashi (JP); Atsushi Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/054,219

(22) Filed: Feb. 26, 2016

(65) Prior Publication Data

US 2016/0250856 A1 Sep. 1, 2016

(30) Foreign Application Priority Data

Feb. 27, 2015 (JP) ..... 2015-037808

(51) Int. Cl.
*B41J 2/165* (2006.01)
*B41J 2/17* (2006.01)
(Continued)

(52) U.S. Cl.
CPC ..... *B41J 2/165* (2013.01); *B41J 2/16552* (2013.01); *B41J 2/1721* (2013.01);
(Continued)

(58) Field of Classification Search
CPC ..... B41J 2/16552; B41J 2/1721
See application file for complete search history.

(56) References Cited

U.S. PATENT DOCUMENTS

2005/0206701 A1* 9/2005 Komatsu ..... B41J 11/057 347/96
2007/0057990 A1* 3/2007 Yakura ..... B41J 2/16552 347/31

(Continued)

FOREIGN PATENT DOCUMENTS

JP 2001353961 A * 12/2001
JP 2005-014422 A 1/2005
JP 2007217472 A * 8/2007

OTHER PUBLICATIONS

Machine generated Ensligh translation of JP2007-217472A to Tokita, "Liquid Composition for Inkjet, Ink Set for Inkjet, Ink Tank for Inkjet, Method of Inkjet-Recording, and Device of Inkjet-Recording"; retrieved via https://www4.j-platpat.inpit.go.jp/eng/tokujitsu/tkbs_en/TKBS_EN_GM101_SearchResult.action on Sep. 22, 2016; 18pp.*

(Continued)

*Primary Examiner* — Shelby Fidler
(74) *Attorney, Agent, or Firm* — Banner & Witcoff, Ltd.

(57) ABSTRACT

There is provide an ink-jet recording apparatus including: an ink containing a resin dispersion type pigment; an ink-jet head configured to discharge the ink; an absorber which is arranged in an area facing a discharge surface of the ink-jet head, and which is configured to absorb the ink discharged from the ink-jet head; and a liquid agent which contains a water-soluble organic solvent, and which is absorbed in the absorber, wherein a surface tension of an aqueous solution containing the liquid agent at concentration of 5% by weight is not more than 50 mN/m; and a blending percentage by weight of the water-soluble organic solvent in the liquid agent is not less than seven times a blending percentage by weight of the resin dispersion type pigment in the ink.

16 Claims, 3 Drawing Sheets

(51) Int. Cl.
*B41J 11/06* (2006.01)
*B41J 11/00* (2006.01)

(52) U.S. Cl.
CPC ..... *B41J 11/0065* (2013.01); *B41J 11/06* (2013.01); *B41J 2002/1742* (2013.01)

(56) References Cited

U.S. PATENT DOCUMENTS

2011/0242206 A1* 10/2011 Komatsu ..... B41J 2/16505 347/29
2014/0292912 A1* 10/2014 Satoh ..... B41J 2/1721 347/31
2016/0250858 A1* 9/2016 Nakano ..... B41J 2/16532

OTHER PUBLICATIONS

Machine generated English translation of JP2001-353961A to Asatake, "Ink Jet Image Forming Method and Ink Jet Image Recording Liquid"; retrieved via https://www4.j-platpat.inpit.go.jp/eng/tokujitsu/tkbs_en/TKBS_EN_GM101_SearchResult.action on Sep. 22, 2016; 16pp.*
Jul. 5, 2016—(EP) Extended Search Report—App 16157712.7.
Feb. 17, 2017—(EP)—Examination Report—App 16157712.7.

* cited by examiner

INK-JET RECORDING APPARATUS AND ACCUMULATION SUPPRESSING METHOD

CROSS REFERENCE TO RELATED APPLICATION

The present application claims priority from Japanese Patent Application No. 2015-037808 filed on Feb. 27, 2015, the disclosure of which is incorporated herein by reference in its entirety.

BACKGROUND

Field of the Invention

The present invention relates to an ink-jet recording apparatus and an accumulation suppressing method.

Description of the Related Art

In an ink-jet recording apparatus configured to perform a borderless recording on a recording paper (recording paper sheet) by discharging an ink from an ink-jet head toward the recording paper, a colorant accumulates in a surface of an ink absorber which is arranged on a platen, in some cases. In a case that this accumulation of the colorant occurs, an end surface of the recording paper contacts an accumulated colorant (accumulated matter), which in turn causes such a problem that the end surface of the recording paper is contaminated (dirtied) by the accumulated matter. In order to solve this problem, there is proposed an ink-jet recording apparatus in which a colorant used in the ink and a solvent impregnated in the ink absorber are specified to thereby suppress the accumulation of the colorant in the surface of the ink absorber (see Japanese Patent Application Laid-open No. 2005-14422).

In the recent years, as ink-jet recording apparatuses perform operations at a higher speed, an ink discharge amount discharged onto the surface of the ink absorber per unit time tends to be increased. In a case that the ink discharge amount is increased, the amount of the colorant accumulated in the surface of the ink absorber is also increased, leading to such a fear that not only an end surface of the recording paper, but also a discharge surface of the ink-jet head is also contaminated by the accumulated colorant. In view of this, the ink-jet recording apparatuses are required to further suppress the accumulation of colorant in the surface of the absorber.

In view of this situation, an object of the present teaching is to provide an ink-jet recording apparatus and an accumulation suppressing method capable of further suppressing the accumulation of colorant in the surface of the absorber.

SUMMARY

According to a first aspect of the present teaching, there is provided an ink-jet recording apparatus including:

an ink containing a resin dispersion type pigment;

an ink-jet head configured to discharge the ink:

an absorber which is arranged in an area facing a discharge surface of the ink-jet head, and which is configured to absorb the ink discharged from the ink-jet head; and a liquid agent which contains a water-soluble organic solvent, and which is absorbed in the absorber, wherein a surface tension of an aqueous solution containing the liquid agent at concentration of 5% by weight is not more than 50 mN/m; and a blending percentage by weight of the water-soluble organic solvent in the liquid agent is not less than seven times a blending percentage by weight of the resin dispersion type pigment in the ink.

According to a second aspect of the present teaching, there is provided an accumulation suppressing method for suppressing accumulation of a resin dispersion type pigment in a surface of an absorber in an ink-jet recording apparatus including: an ink-jet head configured to discharge an ink containing the resin dispersion type pigment; and the absorber which is configured to absorb the ink, the method including:

discharging the ink from the ink-jet head; and absorbing the ink, discharged from the ink-jet head, with the absorber which is arranged in an area facing a discharge surface of the ink-jet head, and which contains a liquid agent containing a water-soluble organic solvent, wherein a surface tension of an aqueous solution containing the liquid agent at concentration of 5% by weight is not more than 50 mN/m; and a blending percentage by weight of the water-soluble organic solvent in the liquid agent is not less than seven times a blending percentage by weight of the resin dispersion type pigment in the ink.

DESCRIPTION OF THE EMBODIMENTS

Figure 1:
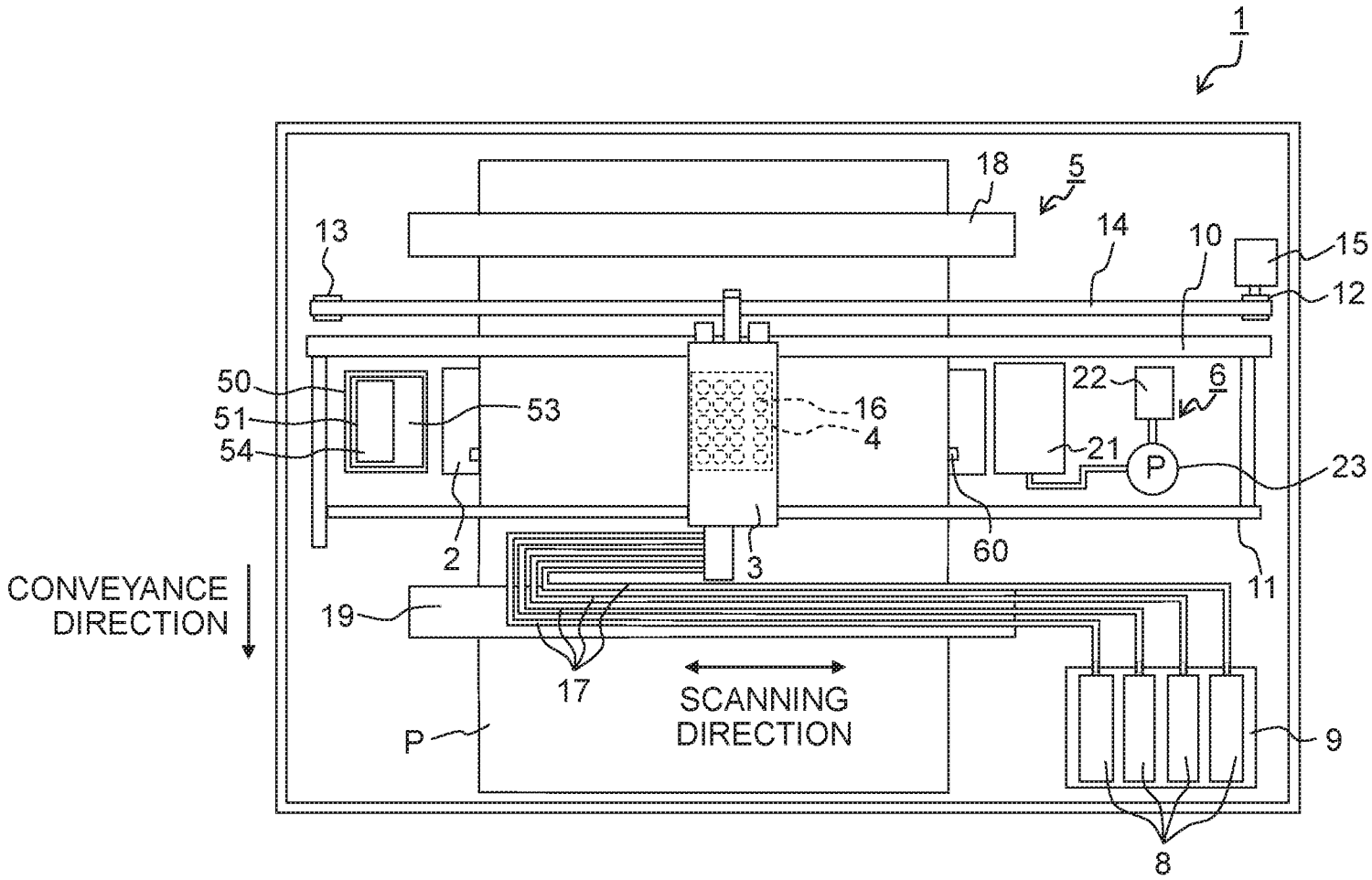
FIG. 1 is a schematic plane view depicting the configuration of an example of an ink-jet recording apparatus related to the present teaching.

An ink-jet recording apparatus and an accumulation suppressing method related to the present teaching will be explained. The ink-jet recording apparatus related to the present teaching includes an ink containing a resin dispersion type pigment (water-based ink for ink-jet recording); an ink-jet head configured to discharge the ink; an absorber which is arranged in an area facing a discharge surface of the ink-jet head, and which is configured to absorb the ink discharged from the ink-jet head; and a liquid agent which contains a water-soluble organic solvent, and which is absorbed (configured to be absorbable) in the absorber. The ink-jet head may be of any system including the piezoelectric element system, the thermal ink-jet system, the electrostatic attraction system, etc. The absorber is preferably at least one of a flushing foam and a platen foam, wherein the flushing foam is arranged in a non-recording area of the ink-jet recording apparatus, and the platen foam is arranged in a recording area of the ink-jet recording apparatus. The details of the liquid agent will be described later on. In the ink-jet recording apparatus related to the present teaching, the configurations of the ink-jet recording apparatus, except for those of the absorber and the liquid agent, may be similar to that of a conventional ink-jet recording apparatus. The accumulation suppressing method related to the present teaching is practiced by using the ink-jet recording apparatus related to the present teaching.

The ink-jet head may discharge a liquid for ink-jet recording different from the ink. Such the liquid different from the ink can be exemplified, for example, by a treatment solution (treatment liquid) used in the ink-jet recording, etc. The treatment liquid is a liquid which is discharged to a recording medium before or after the discharge of ink, for the purpose of improving the quality of image (image quality), etc. Further, the liquid discharged from the ink-jet head is not limited to a liquid to be used for ink-jet recording, and is exemplified, for example, by a shipping liquid (preservative liquid), an introductory liquid, an inspection liquid, etc. The shipping liquid is a liquid charged into a flow channel, of an ink-jet recording apparatus, in a state of shipped out from the factory so as to preserve that state inside the flow channel. The introductory liquid is a liquid which is charged in advance into the flow channel of the ink-jet recording apparatus in the factory at the time of shipment of the ink-jet recording apparatus from the factory such that, when the ink-jet recording apparatus is purchased by an user and the ink is introduced into the flow channel, the ink is easily introduced into the flow channel. The inspection liquid is a liquid to be used for inspecting the discharge of the ink-jet head in the factory. The discharge of these liquids is performed, for example, by driving an actuator of the ink-jet head. These liquids may be lead out (discharged) from the ink-jet head, for example, by suction, etc., rather than by the discharge. It is allowable to prepare these liquid on site, or to use any commercially available liquid products as these liquids.

In the ink, the resin dispersion type pigment is dispersed in a solvent with a resin for dispersing pigment or pigment-dispersing resin (polymeric dispersant). It is allowable to use, as the pigment-dispersing resin, a pigment-dispersing resin of a general type. The resin dispersion type pigment is not particularly limited, and is exemplified, for example, by carbon black, an inorganic pigment, an organic pigment, etc. The carbon black is exemplified, for example, by furnace black, lamp black, acetylene black, channel black, etc. The inorganic pigment is exemplified, for example, by titanium oxide, inorganic pigments based on iron oxide, inorganic pigments based on carbon black, etc. The organic pigment is exemplified, for example, by azo-pigments such as azo lake, insoluble azo-pigment, condensed azo-pigment, chelate azo-pigment, etc.; polycyclic pigments such as phthalocyanine pigment, perylene and perynon pigments, anthraquinone pigment, quinacridone pigment, dioxadine pigment, thioindigo pigment, isoindolinone pigment, quinophthalone pigment etc.; dye lake pigments such as basic dye type lake pigment, acid dye type lake pigment etc.; nitro pigments; nitroso pigments; aniline black daylight fluorescent pigment; and the like. As resin dispersion type pigments different from the above-described resin dispersion type pigments are exemplified, for example, by C. I. Pigment Blacks 1, 6, and 7; C. I. Pigment Yellows 1, 2, 3, 12, 13, 14, 15, 16, 17, 55, 74, 78, 150, 151, 154, 180, 185, and 194; C. I. Pigment Oranges 31 and 43; C. I. Pigment Reds 2, 3, 5, 6, 7, 12, 15, 16, 48, 48:1, 53:1, 57, 57:1, 112, 122, 123, 139, 144, 146, 149, 166, 168, 175, 176, 177, 178, 184, 185, 190, 202, 221, 222, 224, and 238; C. I. Pigment Violet 19, 196; C. I. Pigment Blues 1, 2, 3, 15, 15:1, 15:2, 15:3, 15:4, 16, 22, and 60; C. I. Pigment Greens 7 and 36; and the like. Further, the resin dispersion type pigment may be a solid solution of any one of the above-described pigments.

The solid content blending amount of the resin dispersion type pigment (pigment solid content amount) in the entire amount of the ink is not particularly limited, and may be appropriately determined based on, for example, desired optical density or color (chromaticness, hue, tint), etc. The pigment solid content amount is, for example, in a range of 0.1% by weight to 20% by weight, is preferably in a range of 3.5% by weight to 6% by weight, and is more preferably in a range of 4.5% by weight to 6% by weight. The accumulation of the resin dispersion type pigment in the surface of the absorber tends to occur more easily as the pigment solid content amount is greater. According to the present teaching, however, the problem of accumulation of pigment as described above can be solved without depending on the pigment solid content amount.

As described above, it is allowable to use, as the resin for dispersing pigment (polymeric dispersant), any resin for dispersing pigment (polymeric dispersant) of a general type, such as those exemplified by: proteins such as gelatin, albumin, casein, etc.; natural rubbers such as gum arabic, gum traganth, etc.; glucosides such as saponin, etc.; naturally-occurring polymers such as lignin sulfonate, shellac, etc.; anionic polymers such as acrylic acid-acrylic acid ester copolymer and salt thereof, polyacrylate, polymethacrylate, salt of styrene-acrylic acid copolymer, salt of vinylnaphthalene-acrylic acid copolymer, salt of styrene-maleic acid copolymer, salt of maleic acid-maleic anhydride copolymer, salt of vinylnaphthalene-maleic acid copolymer, sodium salt of β-naphthalenesulfonic acid formalin condensate, orthophosphate, etc.; nonionic polymers such as polyvinyl alcohol, polyvinyl pyrrolidone, etc.; and the like.

The blending amount of the resin for dispersing pigment (polymeric dispersant) in the entire amount of the ink is not particularly limited, and may be appropriately determined, for example, depending on the kind of the resin dispersion type pigment, the pigment solid content amount, etc.

The ink may further contain a colorant such as other pigment, dye, etc., in addition to the resin dispersion type pigment. Alternatively, it is allowable that the ink does not contain any other pigment, dye, etc. Note that although the pigment accumulates on the surface of the absorber more easily than the dye, the present teaching is capable of solving the problem of accumulation associated with the pigment.

The ink may further contain water. The water is preferably ion-exchanged water or pure water (purified water). The blending amount of the water in the entire amount of the ink may be, for example, in a range of 10% by weight to 90% by weight, and preferably in a range of 40% by weight to 80% by weight. The blending amount of the water may be, for example, the balance of the other components.

The ink may further contain a water-soluble organic solvent. The water-soluble organic solvent is exemplified, for example, by a humectant which prevents the ink from drying at an end of a nozzle in an ink-jet head, a penetrant which adjusts the drying velocity on a recording medium, etc.

The humectant is not particularly limited, and is exemplified, for example, by lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones such as acetone; ketoalcohols (ketone alcohols) such as diacetone alcohol; ethers such as tetrahbydrofuran and dioxane; polyethers such as polyalkylene glycol; polyvalent alcohols such as alkylene glycol, glycerol, trimethylolpropane, trimethylolethane; 2-pyrrolidone; N-methyl-2-pyrrolidone; 1,3-dimethyl-2-imidazolidinone; and the like. The polyalkylene glycol is exemplified, for example, by polyethylene glycol, polypropylene glycol, etc. The alkylene glycol is exemplified, for example, by ethylene glycol, propylene glycol, butylene glycol, diethylene glycol, triethylene glycol, dipropylene glycol, tripropylene glycol, thiodiglycol, hexylene glycol, etc. It is allowable that only one kind of the humectant as described above is used singly, or two or more kinds of the humectant are used in combination. Among the above-described humectants, it is preferable to use polyvalent alcohols such as alkylene glycol, glycerol, etc.

The blending amount of the humectant in the entire amount of the ink is, for example, in a range of 0% by weight to 95% by weight, preferably in a range of 5% by weight to 80% by weight, and more preferably in a range of 5% by weight to 50% by weight.

The penetrant is not limited, and is exemplified, for example, by glycol ether. The glycol ether is exemplified, for example, by ethylene glycol methyl ether, ethylene glycol ethyl ether, ethylene glycol-n-propyl ether, diethylene glycol methyl ether, diethylene glycol ethyl ether, diethylene glycol-n-propyl ether, diethylene glycol-n-butyl ether, diethylene glycol-n-hexyl ether, triethylene glycol methyl ether, triethylene glycol ethyl ether, triethylene glycol-n-propyl ether, triethylene glycol-n-butyl ether, propylene glycol methyl ether, propylene glycol ethyl ether, propylene glycol-n-propyl ether, propylene glycol-n-butyl ether, dipropylene glycol methyl ether, dipropylene glycol ethyl ether, dipropylene glycol-n-propyl ether, dipropylene glycol-n-butyl ether, tripropylene glycol methyl ether, tripropylene glycol ethyl ether, tripropylene glycol-n-propyl ether, tripropylene glycol-n-butyl ether, etc. One kind of the penetrant may be used singly, or two or more kinds of the penetrant may be used in combination.

The blending amount of the penetrant in the entire amount of the ink is, for example, in a range of 0% by weight to 20% by weight, preferably in a range of 0% by weight to 15% by weight, more preferably in a range of 1% by weight to 4% by weight.

The ink may further contain a conventionally known additive, as necessary. The additive includes, for example, surfactants, pH-adjusting agents, viscosity-adjusting agents, surface tension-adjusting agents, fungicides, etc. The viscosity-adjusting agents include, for example, polyvinyl alcohol, cellulose, water-soluble resin, etc.

The ink can be prepared, for example, such that firstly an aqueous dispersion of pigment in which a resin dispersion type pigment is dispersed in water with a resin for dispersing pigment (polymeric dispersant) by any conventionally known method is prepared, and then the aqueous dispersion of the pigment, water, the water-soluble organic solvent, and optionally other additive component(s) as necessary are mixed uniformly or homogeneously by any conventionally known method, and undissolved matters are removed by a filter or the like.

Next, the liquid agent will be explained. The absorber contains the liquid agent containing the water-soluble organic solvent. In the present teaching, the liquid agent may be contained in the absorber before the absorber absorbs the ink discharged from the ink-jet head such that the ink discharged from the ink-jet head can contact the liquid agent inside the absorber. Consequently, it is allowable that the liquid agent is either contained or not contained in the absorber in a factory at the time of shipment of the ink-jet recording apparatus from the factory. For example, the liquid agent may be charged in advance into the ink-jet head and the ink flow channel of the ink-jet recording apparatus at the time of shipment of the ink-jet recording apparatus from the factory, and when the ink is introduced into the ink-jet head and the ink flow channel, the liquid agent may be discharged onto the absorber with the ink-jet head such that the liquid agent is absorbed in (by) the absorber. In such a manner, it is allowable that the liquid agent is either contained or not contained in the absorber at the time of shipment of the ink-jet recording apparatus from the factory. For the following reason, however, the liquid agent is preferably contained in the absorber when the ink-jet recording apparatus is shipped from the factory. Namely, in a case that the liquid agent is not contained in the absorber when the ink-jet recording apparatus is shipped from the factory, the liquid agent is discharged by the ink-jet head as described above. In such a case, the liquid agent is required to have a physical property such that the liquid agent can be discharged from the ink-jet head. Accordingly, there is such a fear that the water-soluble organic solvent might not be contained in the liquid agent in a sufficient blending ratio. In particular, the above situation might be problematic in a case that an ink-jet head of the thermal ink-jet system is used as the ink-jet head. Further, there is also such a fear that it might be difficult to allow the absorber to contain a sufficient amount of the liquid agent. On the other hand, in a case that the liquid agent is contained in the absorber when the ink-jet recording apparatus is shipped from the factory, etc., the liquid agent can contain the water-soluble organic solvent in a sufficient blending ratio, and it is also easy to allow the sufficient amount of the liquid agent to be contained in the absorber.

The surface tension of the liquid agent, under a condition that the liquid agent is prepared as an aqueous solution in which concentration of the liquid agent is 5% by weight, is not more than 50 mN/m. Namely, a surface tension of an aqueous solution containing the liquid agent at concentration of 5% by weight is not more than 50 mN/m. Note that in the present teaching, the phrase that "concentration of the liquid agent is 5% by weight" does not mean that the liquid agent is absorbed in (by) the absorber at this concentration, but is an expression for specifying the property of the liquid agent to be absorbed in (by) the absorber. Further, the phrase that "under a condition that the liquid agent is prepared as an aqueous solution in which concentration of the liquid agent is 5% by weight" means preferably such a state that "under a condition that the liquid agent is prepared as an aqueous solution in which the liquid agent is dissolved in 95% by weight of pure water (purified water) (solvent) so that concentration of the liquid agent in the aqueous solution is 5% by weight". The surface tension is preferably in a range of 29 mN/m to 49 mN/m, more preferably is not less than 30 mN/m. The surface tension is a value which is measured, for example, at 25 degrees Celsius. The surface tension can be measure by using, for example, any general device such as a surface tensiometer CBVP-Z (mode name) manufactured by KYOWA INTERFACE SCIENCE CO., LTD.

As the water-soluble organic solvent contained in the liquid agent, it is allowable to use publicly or conventionally known products or substances. The water-soluble organic solvent is exemplified, for example, by polyether, polyvalent (polyhydric) alcohol, polyvalent alcohol derivative, alcohol, amide, ketone, ketoalcohol (ketone alcohol), ether, nitrogen-containing solvent, sulfur-containing solvent, propylene carbonate, ethylene carbonate, 1,3-dimethyl-2-imidazolidinone, etc. The polyether is exemplified, for example, by polyethylene glycol, polypropylene glycol, etc. The polyvalent alcohol is exemplified, for example, by glycerol, ethylene glycol, diethylene glycol, propylene glycol, butylene glycol, hexylene glycol, triethylene glycol, dipropylene glycol, tripropylene glycol, trimethylolpropane, 1,5-pentanediol, 1,2,6-hexanetriol, etc. The polyvalent alcohol derivative is exemplified, for example, by ethylene glycol methyl ether, ethylene glycol ethyl ether, ethylene glycol-n-propyl ether, ethylene glycol-n-butyl ether, diethylene glycol methyl ether, diethylene glycol ethyl ether, diethylene glycol-n-propyl ether, diethylene glycol-n-butyl ether, diethylene glycol-n-hexyl ether, triethylene glycol methyl ether, triethylene glycol ethyl ether, triethylene glycol-n-propyl ether, triethylene glycol-n-butyl ether, propylene glycol methyl ether, propylene glycol ethyl ether, propylene glycol-n-propyl ether, propylene glycol-n-butyl ether, dipropylene glycol methyl ether, dipropylene glycol ethyl ether, dipropylene glycol-n-propyl ether, dipropylene glycol-n-butyl ether, tripropylene glycol methyl ether, tripropylene glycol ethyl ether, tripropylene glycol-n-propyl ether, and tripropylene glycol-n-butyl ether, etc. The alcohol is exemplified, for example, by methyl alcohol, ethyl alcohol, n-propyl alcohol, isopropyl alcohol, n-butyl alcohol, sec-butyl alcohol, isobutyl alcohol, tert-butyl alcohol, benzyl alcohol, etc. The amide is exemplified, for example, by dimethylformamide, dimethylacetamide, etc. The ketone is exemplified, for example, by acetone, etc. The ketone alcohol (ketoalcohol) is exemplified, for example, by diacetone alcohol, etc. The ether is exemplified, for example, by tetrahydrofuran, dioxane, etc. The nitrogen-containing solvent is exemplified, for example, by pyrrolidone, 2-pyrrolidone, N-methyl-2-pyrrolidone, cyclohexyl pyrrolidone, triethanolamine, etc. The sulfur-containing solvent is exemplified, for example, by thiodiethanol, thiodiglycol, thiodiglycerol, sulfolane, dimethylsulfoxide, etc. Among the above-described substances, alkylene glycol and alkylene glycol ether are preferred; and triethylene glycol, diethylene glycol, tripropylene glycol and triethylene glycol-n-butyl ether are more preferred. One kind of the water-soluble organic solvent may be used singly, or two or more kinds of the water-soluble organic solvent may be used together.

As described above, the blending amount (% by weight) (the blending percentage by weight) of the water-soluble organic solvent in the liquid agent is not less than seven times the blending amount (% by weight) (the blending percentage by weight) of the resin dispersion type pigment in the ink. From the viewpoint of effect of improving suppressing the accumulation, the blending amount (% by weight) of the water-soluble organic solvent in the liquid agent is preferably not less than eleven times the blending amount (% by weight) of the resin dispersion type pigment in the ink. Although the blending amount (% by weight) of the water-soluble organic solvent in the liquid agent relative to the blending amount (% by weight) of the resin dispersion type pigment in the ink is not particularly limited, the blending amount (% by weight) of the water-soluble organic solvent in the liquid agent is, for example, not more than 30 times the blending amount (% by weight) of the resin dispersion type pigment in the ink. In a case that the blending amount of the water-soluble organic solvent in the liquid agent has the above-described ratio to the blending amount of the resin dispersion type pigment in the ink, it is possible to obtain sufficient accumulation-suppressing effect. Accordingly, there is no need to contain the water-soluble organic solvent in a further increased amount exceeding the above-described ratio. On the other hand, in a case that the blending amount of the resin dispersion type pigment in the ink is relatively great, for example, in such a case that the blending amount of the resin dispersion type pigment in the ink is in a range of 4.5% by weight to 6% by weight, the blending amount (% by weight) of the water-soluble organic solvent in the liquid agent is not more than 23 times the blending amount (% by weight) of the resin dispersion type pigment in the ink.

It is preferable that the liquid agent additionally contains a surfactant, as the water-soluble organic solvent. Accordingly, in the present teaching, in a case that the liquid agent additionally contains the surfactant, the phrase of the "blending amount of the water-soluble organic solvent in the liquid agent" means a total (total amount) of the blending amount of the water-soluble organic solvent, different from the surfactant, in the entire amount of the liquid agent and the blending amount of the surfactant in the entire amount of the liquid agent. The surfactant is not particularly limited, and is exemplified, for example, by anionic surfactants of "EMAL (trade name)" series, "LATEMUL (trade name)" series, "VENOL (trade name)" series, "NEOPELEX (trade name)" series, NS SOAP, KS SOAP, OS SOAP, and "PELEX (trade name)" series, etc., produced by KAO CORPORATION; anionic surfactants of "LIPOLAN (trade name)" series, "LIPON (trade name)" series, "SUNNOL (trade name)" series, "LIPOTAC (trade name)" series, "TE, ENAGICOL (trade name)" series, "LIPAL (trade name)" series, and "LOTAT (trade name)" series, etc., produced by LION CORPORATION; nonionic surfactants of "OLFIN (trade name)" series produced by NISSHIN CHEMICAL CO., LTD.; nonionic surfactants of "EMULGEN (trade name)" series, "RHEODOL (trade name)" series, "EMASOL (trade name)" series, "EXCEL (trade name)" series. "EMANON (trade name)" series, "AMIET (trade name)" series, "AMINON (trade name)" series, etc., produced by KAO CORPORATION; nonionic surfactants of "SORBON (trade name)" series produced by TOHO CHEMICAL INDUSTRY CO., LTD.; nonionic surfactants of "DOBANOX (trade name)" series, "LEOCOL (trade name)" series, "LEOX (trade name)" series, "LAOL, LEOCON (trade name)" series, "LIONOL (trade name)" series, "CADENAX (trade name)" series. "LIONON (trade name)" series, "LEOFAT (trade name)" series, etc., produced by LION CORPORATION; cationic surfactants "KACHIOGEN (trade name) ES-OW" and "KACHIOGEN (trade name) ES-L" produced by DAI-ICHI KOGYO SEIYAKU CO., LTD., etc. Among the above-described surfactants, an acetylene glycol-based nonionic surfactant is preferred. It is allowable that only one kind of the surfactant as described above is used singly, or two or more kinds of the surfactant are used in combination.

The blending amount of the water-soluble organic solvent in the entire amount of the liquid agent is, for example, in a range of 10% by weight to 100% by weight, preferably in a range of 25% by weight to 100% by weight, and more preferably in a range of 50% by weight to 100% by weight. Here, in a case that the liquid agent does not additionally contain the surfactant, the phrase of the "blending amount of the water-soluble organic solvent in the entire amount of the liquid agent" means the blending amount of the water-soluble organic solvent, different from the surfactant, in the entire amount of the liquid agent; on the other hand, in a case that the liquid agent additionally contains the surfactant, the phrase of the "blending amount of the water-soluble organic solvent in the entire amount of the liquid agent" means a total (total amount) of the blending amount of the water-soluble organic solvent, different from the surfactant, in the entire amount of the liquid agent and the blending amount of the surfactant in the entire amount of the liquid agent.

The blending amount of the water-soluble organic solvent, different from the surfactant, in the entire amount of the liquid agent is in a range of 0.1% by weight to 25% by weight, preferably in a range of 0.5% by weight to 22% by weight, and more preferably in a range of 0.5% by weight to 4% by weight.

The blending amount of the surfactant in the entire amount of the liquid agent is, for example, in a range of 0.5% by weight to 30% by weight, preferably in a range of 0.5% by weight to 25% by weight, and more preferably in a range of 0.5% by weight to 22% by weight. In a case that the blending amount of the surfactant is within the above-described range, it is possible to adjust each of the surface tension and the viscosity of the liquid agent to be within a suitable range, and to improve the effect of suppressing the accumulation of pigment.

It is allowable that the liquid agent additionally contains, or does not additionally contains, the surfactant as the water-soluble organic solvent. However, from the viewpoint of adjusting the surface tension of the liquid agent within the specific range, the liquid agent preferably contains, as the water-soluble organic solvent, both of the water-soluble organic solvent that is different from the surfactant, and the surfactant. In a case that the water-soluble organic solvent contains the surfactant, the ratio of the surfactant in the water-soluble organic solvent is, for example, in a range of 1% by weight to 72% by weight, preferably in a range of 1.4% by weight to 63% by weight, and more preferably in a range of 1.4% by weight to 12% by weight.

In the liquid agent, the water-soluble organic solvent may contain the surfactant, and one selected from the group consisting of: alkylene glycol and alkylene glycol ether. In the liquid agent, the water-soluble organic solvent may contain an acetylene glycol-based nonionic surfactant, and one selected from the group consisting of: triethylene glycol, diethylene glycol, tripropylene glycol and triethylene glycol-n-butyl ether.

It is allowable that the liquid agent further contains water, or that the liquid agent does not contain water. The water is preferably ion-exchanged water or pure water (purified water). The blending amount of the water in the entire amount of the liquid agent is, for example, in a range of 0% by weight to 90% by weight, preferably in a range of 0% by weight to 75% by weight, more preferably in a range of 0% by weight to 50% by weight.

It is allowable that the liquid agent further contains, or does not contain, any other conventionally known additive(s) exemplified by rust-preventing agents, fungicides, etc., as necessary. Note that the liquid agent may be composed only of the water-soluble organic solvent different from the surfactant, and the water, may be composed only of the water-soluble organic solvent different from the surfactant, and the surfactant, or may be composed only of the water-soluble organic solvent different from the surfactant, the surfactant and the water.

The liquid agent can be prepared, for example, such that the water-soluble organic solvent, and optionally the water and the other additive component(s) as necessary are mixed uniformly or homogeneously by any conventionally known method, and undissolved matters are removed by a filter or the like.

Next, the absorber will be explained. As described above, the absorber is preferably at least one of the flushing foam and the platen foam, wherein the flushing foam is arranged in the non-recording area of the ink-jet recording apparatus, and the platen foam is arranged in the recording area of the ink-jet recording apparatus. The absorber may be any absorber provided that the absorber is capable of absorbing the ink. For example, the absorber is exemplified by melamine foam, urethane foam, polyethylene foam, silicone foam, acrylic foam, chloroprene rubber (CR) sponge, natural rubber (NR) sponge, nitrile rubber (NBR) sponge, ethylene propylene diene rubber (EPDM) sponge, felt foam, needle felt among which melamine foam is preferable. Note that the absorber related to the present teaching is one of the components or parts constructing the ink-jet recording apparatus, and is different, for example, from the recording medium such as recording paper (recording paper sheet).

Further, from the viewpoint of allowing the liquid agent to permeate into the absorber sufficiently, the amount of the liquid agent contained in the absorber (the amount (μg) of the liquid agent contained per unit volume ($mm^3$) of the absorber) is preferably not less than 0.10 μg/mm; further, in view of preventing the liquid agent from leaking out the absorber in such a case that any reaction force is applied to the absorber during transportation, etc. of the ink-jet recording apparatus, the amount of the liquid agent contained in the absorber is preferably not more than 0.91 $\mu g/mm^3$. More preferably, the amount of the liquid agent contained in the absorber is in a range of not less than 0.20 $\mu g/mm^3$ and not more than 0.70 $\mu g/mm^3$.

Furthermore, the amount of the liquid agent contained in the absorber may be determined depending on, for example, the concentration of the pigment contained in the ink, the period of service life or lifetime of the ink-jet recording apparatus, etc. In a case that the absorber is at least one of the flushing foam and the platen foam, the lower limit value of the amount of the water-soluble organic solvent contained in the absorber is, for example, not less than 0.10 g, and is preferably not less than 0.18 g; the upper limit value of the amount of the water-soluble organic solvent contained in the absorber is, for example, not more than 0.81 g, and is preferably not more than 0.63 g.

FIG. 1 depicts the configuration of an example of the ink-jet recording apparatus related to the present teaching. As depicted in FIG. 1, an ink-jet recording apparatus 1 includes a platen 2, a carriage 3, an ink-jet head 4, a conveyance mechanism 5 and a maintenance unit 6 as main constitutive components or parts.

A recording medium (for example, recording paper or recording sheet) P supplied from a paper feeding mechanism (not depicted in the drawings) is placed on the upper surface of the platen 2. Two guide rails 10 and 11 are arranged at a position above or over the platen 2, and extend parallel to each other in a scanning direction (left/right direction in FIG. 1). The carriage 3 is configured to be movable in a reciprocating manner in the scanning direction along the two guide rails 10 and 11 in an area at which the carriage 3 faces or is opposite to the platen 2.

The two guide rails 10 and 11 extend in the scanning direction to further protrude from the left and right ends of the platen 2. The carriage 3 is configured to be movable from the area facing the recording paper P on the platen 2 (recording area) to a position located away from both of the left/right ends of the platen 2 (non-recording area). An endless belt 14 wound between two pulleys 12 and 13 is connected to the carriage 3. By driving the endless belt 14 to run by a carriage driving motor 15, the carriage 3 is reciprocated (moved) in the scanning direction, accompanying with the running of the endless belt 14.

The ink-jet head 4 is installed in a lower portion of the carriage 3. The lower surface of the ink-jet head 4 is a discharge surface 4*a* (see FIG. 2) which is parallel to the upper surface of the platen 2 and in which a plurality of nozzles 16 are opened. The ink is discharged from the plurality of nozzles 16 of the discharge surface 4*a* toward the recording paper P placed on the platen 2 so as to perform recording on the recording paper P.

Four ink supply ports (not depicted in the drawings) corresponding to colors of black, yellow, cyan and magenta, respectively are provided on the upper surface of the ink-jet head 4, and one ends of four tubes 17 are connected to the four ink supply ports, respectively. The other ends of the four tubes 17 are connected to a cartridge installation section 9 that is configured such that four ink cartridges 8 storing the four color inks respectively are detachably attached to the cartridge installation section 9. With this configuration, the inks of the respective four colors are supplied to the ink-jet head 4 from the four ink cartridges 8 installed in the cartridge installation section 9 via the four tubes 17, respectively. In the ink-jet recording apparatus 1, at least one ink among the four inks is the ink containing the resin dispersion type pigment.

The conveyance mechanism 5 has two conveyance rollers 18 and 19 which are arranged so as to sandwich the platen 2 therebetween in a conveyance direction (direction from the upper portion to the lower portion on the sheet surface in FIG. 1). The recording paper P placed on the platen 2 is conveyed in the conveyance direction by the two conveyance rollers 18 and 19.

The ink-jet recording apparatus 1 discharges the ink from the ink-jet head 4 installed in the carriage 3 toward the recording paper P placed on the platen 2 and conveys the recording paper P in the conveyance direction by the two conveyance rollers 18 and 19, thereby recording desired image and/or letter, etc., on the recording paper P.

Next, the maintenance unit 6 will be explained. The maintenance unit 6 includes a purge unit and a flushing unit. The purge unit has a waste liquid foam 22, a suction cap 21 and a suction pump 23 which are arranged on one side in the scanning direction (on the right side in FIG. 1) with respect to the platen 2. The flushing unit is arranged on the other side in the scanning direction (on the left side in FIG. 1) with respect to the platen 2, and includes a first flushing foam 53, a second flushing foam 54, a waste liquid tank 50 and a liquid receiving member 51, as main constitutive components or parts.

The suction cap 21 is driven by a cap driving mechanism including a driving mechanism such as a motor (not depicted) so that the suction cap 21 is driven to move in the up and down direction and to make approach/separation with respect to the discharge surface 4*a*. The suction pump 23 is connected to the suction cap 21. When the suction cap 21 makes contact with the discharge surface 4*a*, the suction cap 21 covers the openings of the plurality of nozzles 16. In a case that the suction cap 21 performs suction and depressurization in the inside of the suction cap 21 in such a manner, the suction cap 21 causes a liquid (for example, the ink) to be discharged from all of the nozzles 16 covered by the suction cap 21 (suction purge). The suction cap 21 is connected to the waste liquid foam 22. The liquid sucked and made to exit from the nozzles 16 by the suction purge is absorbed by the waste liquid foam 22 via the suction pump 23. Although not depicted in the drawings, the waste liquid foam 22 is accommodated in a box which is open at an upper portion of the box. The waste liquid foam 22 may be any member provided that such a member is capable of absorbing the liquid, such as, for example, a foamed body including a melamine foam, etc. In the embodiment, the purge unit is configured to suck the liquid from the nozzles 16 by the suction pump 23. However, the purge unit may be configured as a so-called "push purge" mechanism which applies pressure to the liquid inside the ink-jet head 4 to thereby cause the liquid to exit from the nozzles 16.

Figure 2:
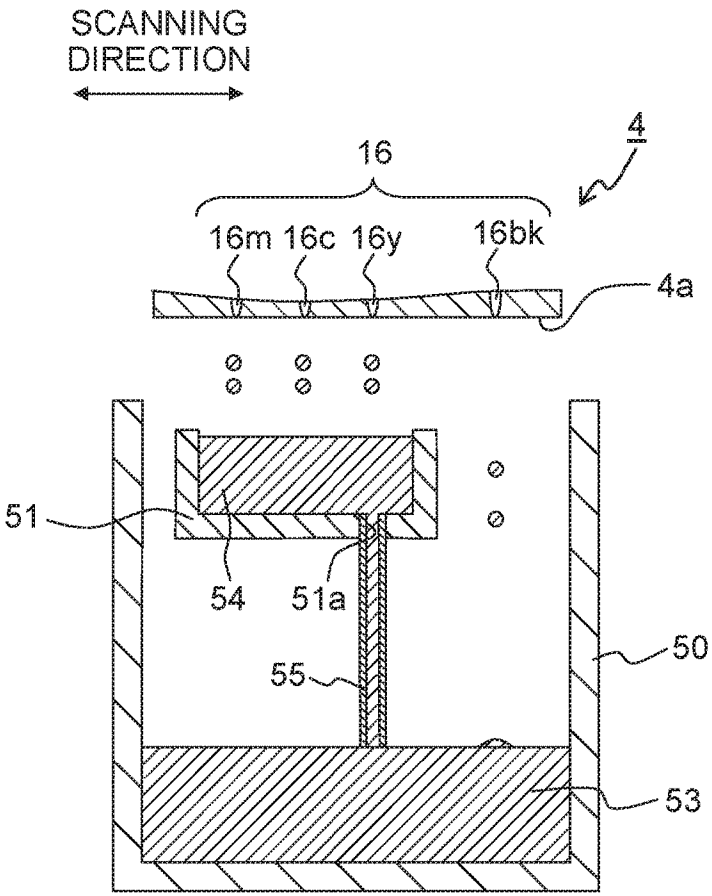
FIG. 2 is a cross-sectional view of a waste liquid tank in a vertical plane including a scanning direction for the ink-jet recording apparatus depicted in FIG. 1 when the ink-jet recording apparatus performs an ink recovery operation.

As depicted in FIG. 2, the waste liquid tank 50 has a box-shape which is open at an upper portion thereof, and accommodates the first flushing foam 53 inside of the waste liquid tank 50. The liquid receiving member 51 is arranged at a position above or over the first flushing foam 53. The liquid receiving member 51 has a box-shape which is open at an upper portion thereof, and accommodates the second flushing foam 54 inside of the liquid receiving member 51. A discharge port 51*a* is formed in the liquid receiving member 51 at a portion on the bottom surface and located on one side in the scanning direction (on the right side in FIG. 2). The discharge port 51*a* is connected to one end of a tube 55 of which other end makes contact with the upper surface of the first flushing foam 53. With this, the ink absorbed by the upper surface of the second flushing foam 54 moves downwardly and is discharged from the discharge port 51*a* to the first flushing foam 53, via the tube 55. Each of the first and second flushing foams 53 and 54 may be any member provided that such a member is capable of absorbing the ink, such as, for example, a foamed body including a melamine foam, etc.

Figure 3A:
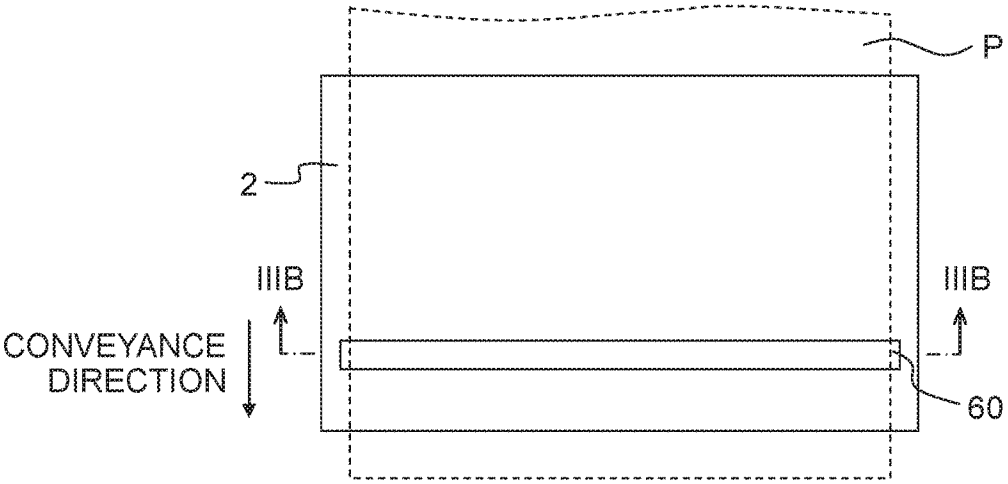
FIG. 3A is a plane view of a platen and a platen foam of the ink-jet recording apparatus depicted in FIG. 1 while the ink-jet recording apparatus is performing the ink recovery operation.
Figure 3B:
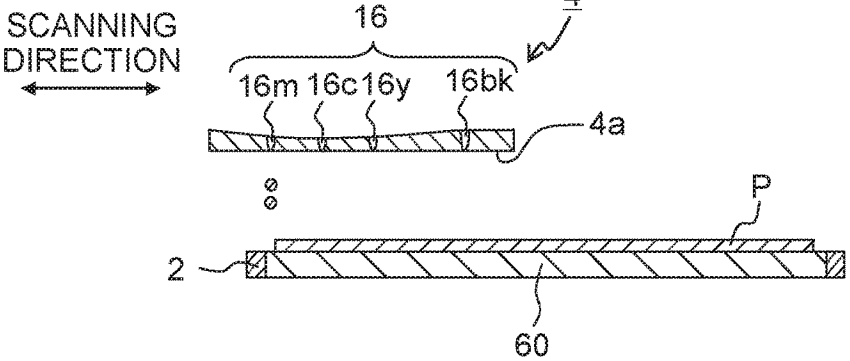
FIG. 3B is a cross-sectional view of FIG. 3A as seen from a direction of a line IIIB-IIIB in FIG. 3A.

Next, a platen foam 60 will be explained with reference to FIGS. 3A and 3B. FIG. 3A is a plan view of the platen 2 and the platen foam 60 when the liquid is being recovered by the ink-jet recording apparatus 1 depicted in FIG. 1 (during a liquid recovery operation of the ink-jet recording apparatus 1), and FIG. 3B is a cross-sectional view as seen from a direction of a line IIIB-IIIB in FIG. 3A. Note that in FIG. 3A, the recording paper P is depicted by broken lines, and the lower portion of the recording paper P is depicted in phantom. As depicted in FIGS. 3A and 3B, the platen foam 60 having a rectangular parallelepiped shape is integrated into the platen 2 at a lower portion of an area in which an end or edge portion of the recording paper P passes. With this, in case of performing for example a borderless recording with respect to the recording paper P, it is possible to absorb, with the platen foam 60, the ink discharged onto the upper surface of the platen 2 beyond the end portion of the recording paper P. The platen foam 60 may be any member provided that such a member is capable of absorbing the ink, such as, for example, a foamed body including a melamine foam, etc. Further, the shape of the platen foam 60 is not limited to the shape of rectangular parallelepiped shape depicted in FIGS. 3A and 3B, and the platen foam 60 may have any shape provided that the platen foam 60 is capable of absorbing the ink discharged beyond the end portion of the recording paper P.

The first flushing foam 53, the second flushing foam 54 and the platen foam 60 contain the liquid agent. In each of the first and second flushing foams 53 and 54 and the platen foam 60, the liquid agent may be contained only at a portion which makes contact with the ink discharged from the ink-jet head 4, or may be contained in the entirety of each of the first and second flushing foams 53 and 54 and the platen foam 60. Further, each of the first flushing foam 53, the second flushing foam 54, and the platen foam 60 may be provided independently (separately) respectively for the colors of the inks discharged from the ink-jet head 4.

Next, an example of the accumulation suppressing method related to the present teaching will be explained with reference to FIG. 2. The example depicted in FIG. 2 is an aspect wherein the accumulation of the resin dispersion type pigment in the surface of the flushing foam is suppressed by discharging the ink from the ink-jet head 4 directly to the flushing foam. FIG. 2 is a cross-sectional view of the waste liquid tank 50 in a vertical plane including the scanning direction when the ink-jet recording apparatus 1 depicted in FIG. 1 performs an ink recovery operation. In FIG. 2, reference numerals "16*bk*", "16*y*", "16*c*" and "16*m*" indicate nozzles 16 for black, yellow, cyan and magenta inks, respectively. In the ink-jet recording apparatus 1, the ink-jet head 4 may further have a nozzle and a supply port for a treatment liquid. The ink-jet recording apparatus 1 may further have a cartridge in which the treatment liquid is stored and a tube for supplying the treatment liquid.

When the ink is recovered in this example, the ink-jet head 4 is stopped, without scanning in the scanning direction, and the inks discharged from the nozzles 16 are discharged immediately downwardly. FIG. 2 depicts an example wherein ink recovery for recovering the black ink from the nozzle 16*bk* and ink recovery for recovering the three color inks that are yellow, cyan and magenta inks from the nozzles 16*y*, 16*c* and 16*m* are performed at the same time. A timing for discharging the ink(s) is exemplified by a timing before starting the recording on recording paper P, a timing between the paper sheets during a continuous recording (from a point of time after completing recording on one sheet of the recording paper P and until a point of time starting the recording on next sheet of the recording paper P), etc.

In FIG. 2, the inks are recovered by discharging the inks of the respective colors that are the black ink and the yellow, cyan and magenta inks from the nozzle 16*bk* of the black ink and the nozzles 16*y*, 16*c* and 16*m* of the three color inks toward the first flushing foam 53 accommodated in the waste liquid tank 50 and the second flushing foam 54 accommodated in the liquid receiving member 51, respectively, at a position at which the nozzle 16*bk* of the black ink is made to face or to be opposite to the first flushing foam 53, and at which the nozzles 16*y*, 16*c* and 16*m* of the three color inks are made to face the second flushing foam 54. Note that the ink recovery of the ink from the nozzle 16*bk* of the black ink and the ink recovery of the inks from the nozzles 16*y*, 16*m*, and 16*c* of the three color inks may be performed separately from each other. Furthermore, although this example uses the different flushing foams separate from each other for the black ink and the color inks, respectively, the present teaching is not limited to this. It is allowable to discharge the black ink and the color inks onto different locations, respectively, on a single flushing foam.

Each of the first and second flushing foams 53 and 54 contains the liquid agent; the liquid agent contains the water-soluble organic solvent, and the surface tension of the liquid agent under a condition that the liquid agent is prepared as an aqueous solution in which concentration of the liquid agent is 5% by weight is not more than 50 mN/m; and the blending amount (% by weight) of the water-soluble organic solvent in the liquid agent is not less than seven times the blending amount (% by weight) of the resin dispersion type pigment in the ink. With this, it is possible to suppress the accumulation of the resin dispersion type pigment. The mechanism by which such an effect of suppressing the accumulation can be obtained is, for example, presumed as follows. Namely, by allowing each of the first and second flushing foams 53 and 54 to contain the water-soluble organic solvent, the particles of the resin dispersion type pigment do not aggregate, and are allowed to permeate (penetrate) to the inside of each of the first and second flushing foams 53 and 54. Further, it is presumed that since each of the first and second flushing foams 53 and 54 contains the liquid agent having the small surface tension, the permeation (penetration) of the ink into the first and second flushing forms 53 and 54 is promoted. Note that, however, the above-described mechanism is merely a presumption, and the present teaching is not limited to and restricted by this presumed mechanism. From the viewpoint of improving the effect of suppressing the accumulation, the ink-jet recording apparatus 1 preferably satisfies the following condition (a):

$$0.9 \leq Y/X \leq 1.3 \quad \text{(a):}$$

wherein:

X: average particle diameter (nm) of the resin dispersion type pigment before the ink makes contact with the first flushing foam 53 or the second flushing foam 54; and Y: average particle diameter (nm) of the resin dispersion type pigment after the ink has made contact with the first flushing foam 53 or the second flushing foam 54.

Next, still another example of the accumulation suppressing method related to the present teaching will be explained with reference to FIG. 3B. The example depicted in FIG. 3B is an aspect wherein the accumulation of the resin dispersion type pigment in the surface of the platen foam 60 is suppressed by discharging the ink from the ink-jet head 4 directly to the platen foam 60. In FIG. 3B, same parts or portions as those in FIG. 2 are assigned with same reference numerals as those in FIG. 2.

When the ink is recovered in this example, the ink-jet head 4 is stopped, without scanning in the scanning direction, and the ink(s) discharged from the nozzles 16 are discharged immediately downwardly. FIG. 3B shows an example wherein the ink is recovered from the nozzle 16*m* for the magenta ink.

In FIG. 3B, the magenta ink is recovered by discharging the magenta ink from the nozzle 16*m* of the magenta ink toward the platen foam 60 integrated into the platen 2, at a position at which the nozzle 16*m* is made to face or to be opposite to the platen foam 60. Note that the recovery of the inks from the nozzles 16*bk*, 16*y* and 16*c* can also be performed by moving the nozzles 16*bk*, 16*y* and 16*c* to positions at each of which one of the nozzles 16*bk*, 16*y* and 16*c* faces the platen foam 60, in a similar manner as for the recovery of the magenta ink from the nozzle 16*m*.

The platen foam 60 contains the liquid agent; the liquid agent contains the water-soluble organic solvent, and the surface tension of the liquid agent under the condition that the liquid agent is prepared as an aqueous solution in which concentration of the liquid agent is 5% by weight is not more than 50 mN/m; and the blending amount (% by weight) of the water-soluble organic solvent in the liquid agent is not less than seven times the blending amount (% by weight) of the resin dispersion type pigment in the ink. With this, it is possible to suppress the accumulation of the resin dispersion type pigment. The mechanism by which such an effect of suppressing the accumulation can be obtained is, for example, presumed as follows. Namely, by allowing the platen foam 60 to contain the water-soluble organic solvent, the particles of the resin dispersion type pigment do not aggregate, and are allowed to permeate (penetrate) to the inside of the platen foam 60. Further, it is presumed that since the platen foam 60 contains the liquid agent having the small surface tension, the permeation (penetration) of the ink into the platen foam 60 is promoted. Note that, however, the above-described mechanism is merely a presumption, and the present teaching is not limited to and restricted by this presumed mechanism. From the viewpoint of improving the effect of suppressing the accumulation, the ink-jet recording apparatus 1 preferably satisfies the following condition (b):

$$0.9 \leq Y/X \leq 1.3 \quad \text{(b):}$$

wherein:

X: average particle diameter (nm) of the resin dispersion type pigment before the ink makes contact with the platen foam 60; and Y: average particle diameter (nm) of the resin dispersion type pigment after the ink has made contact with the platen foam 60.

As described above, according to the present teaching, the absorber configured to absorb the ink containing the resin dispersion type pigment is allowed to absorb (contain) the liquid agent which contains the water-soluble organic solvent, and of which surface tension, under the condition that the liquid agent is prepared as the aqueous solution in which concentration of the liquid agent is 5% by weight, is not more than 50 mN/m; and further the blending amount (% by weight) of the water-soluble organic solvent in the liquid agent is made to be not less than seven times the blending amount (% by weight) of the resin dispersion type pigment in the ink. By doing so, it is possible to further suppress the accumulation of the resin dispersion type pigment in the surface of the absorber. Accordingly, it is possible to prevent the end surface of the recording medium (recording paper) and/or the discharge surface of the ink-jet head from being contaminated by the resin dispersion type pigment accumulated in (on) the surface of the absorber.

EXAMPLES

Next, examples of the present teaching will be explained together with comparative examples. Note that the present teaching is not limited and is not restricted to the examples and the comparative examples which will be described below.

[Preparation of Ink]

Aqueous solutions of pigments in Ink Composition (TABLE 1 as indicated below) were prepared. Namely, at first, pure water (purified water) was added to 5.0% by weight of acrylic acid-acrylic ester copolymer and 20.0% by weight of each of the pigments so that total of the blending amounts of the pure water, the acrylic acid-acrylic ester copolymer and the pigment was 100% by weight, followed by being subjected to agitation and mixing, thereby obtaining a mixture of the pure water, the acrylic acid-acrylic ester copolymer and the pigment. The obtained mixture was subjected to a dispersion treatment for six hours, together with zirconium beads by using a sand mill. Afterwards, the zirconium beads were separated by a separator, and thus an aqueous dispersion of the pigment was obtained. Next, components, except for the aqueous dispersion of the pigment, which were included in Ink Composition (TABLE 1 as indicated below) were mixed uniformly or homogeneously; and thus an ink solvent was obtained. Subsequently, the aqueous dispersion of the pigment was added to the ink solvent, followed by being mixed uniformly. After that, the obtained mixture was filtrated through a cellulose acetate membrane filter (pore size 3.00 μm) produced by TOYO ROSHI KAISHA, LTD., and thus inks 1 to 7 for ink-jet recording were obtained.

TABLE 1

| | | INKS | | | | | | |
|---|---|---|---|---|---|---|---|---|
| | | Ink 1 | Ink 2 | Ink 3 | Ink 4 | Ink 5 | Ink 6 | Ink 7 |
| Ink Composition | Aqueous dispersion of C. I. Pigment Yellow 74 (*1) | 3.5 | 4.5 | 6.0 | — | — | — | — |
| (unit: % by weight) | Aqueous dispersion of C. I. Pigment Red 122 (*1) | — | — | — | 3.5 | 4.5 | 6.0 | — |
| | Aqueous dispersion of C. I. Pigment Blue 15:3 (*1) | — | — | — | — | — | — | 3.5 |
| | Glycerol | 20 | 20 | 20 | 20 | 20 | 20 | 20 |
| | Water | balance | balance | balance | balance | balance | balance | balance |

LEGEND (*1): Resin dispersion type pigment; numeral in the table indicates pigment solid content amount.

The unit in TABLE 1: % by weight

[Preparation of Liquid Agent]

Liquid Agents 1-19 having the compositions depicted in TABLE 2 as below were prepared. type pigment between before and after each of the inks 1 to 7 indicated in TABLE 3 made contact with the melamine foam (Y/X) were measured by the following method.

TABLE 2

| | | | LIQUID AGENTS | | | | | | | | | |
|---|---|---|---|---|---|---|---|---|---|---|---|---|
| | | | 1 | 2 | 3 | 4 | 5 | 6 | 7 | 8 | 9 | 10 |
| Water-soluble organic solvent | Water-soluble organic solvent different from surfactant | Triethylene glycol | 98.0 | 35.0 | 34.5 | 34.0 | 33.0 | 13.0 | 10.0 | 23.0 | 28.0 | 43.0 |
| | | Diethylene glycol | — | — | — | — | — | — | — | — | — | — |
| | | Tripropylene glycol | — | — | — | — | — | — | — | — | — | — |
| | | Triethylene glycol-n-butyl ether | — | — | — | — | — | — | — | — | — | — |
| | | Glycerol | — | — | — | — | — | — | — | — | — | — |
| | Surfactant | OLFIN (trade name) E1010 (*2) | 2.0 | — | 0.5 | 1.0 | 2.0 | 22.0 | 25.0 | 2.0 | 2.0 | 2.0 |
| | | SUNNOL (trade name) NL1430 (*3) | — | — | — | — | — | — | — | — | — | — |
| | Water | | — | 65.0 | 65.0 | 65.0 | 65.0 | 65.0 | 65.0 | 75.0 | 70.0 | 55.0 |

| | | | LIQUID AGENTS | | | | | | | | |
|---|---|---|---|---|---|---|---|---|---|---|---|
| | | | 11 | 12 | 13 | 14 | 15 | 16 | 17 | 18 | 19 |
| Water-soluble organic solvent | Water-soluble organic solvent different from surfactant | Triethylene glycol | 48.0 | 38.0 | 63.0 | 68.0 | — | — | — | — | 31.0 |
| | | Diethylene glycol | — | — | — | — | 98.0 | — | — | — | — |
| | | Tripropylene glycol | — | — | — | — | — | 43.0 | — | — | — |
| | | Triethylene glycol-n-butyl ether | — | — | — | — | — | — | 33.0 | — | — |
| | | Glycerol | — | — | — | — | — | — | — | 45.0 | — |
| | Surfactant | OLFIN (trade name) E1010 (*2) | 2.0 | 2.0 | 2.0 | 2.0 | 2.0 | 2.0 | 2.0 | — | — |
| | | SUNNOL (trade name) NL1430 (*3) | — | — | — | — | — | — | — | — | 4.0 |
| | Water | | 50.0 | 60.0 | 35.0 | 30.0 | — | 55.0 | 65.0 | 55.0 | 65.0 |

LEGEND (*2): Acetylene glycol-based nonionic surfactant (ethylene oxide (10 mol) adduct of diol; produced by NISSHIN KAGAKU KOGYO KK; active ingredient = 100% by weight.

(*3): Anionic surfactant; produced by LION CORPORATION; active ingredient = 28% by weight; numeral in the table indicates active ingredient amount.

The unit in TABLE 2: % by weight.

Examples 1-1 to 1-71

Examples 1-1 to 1-7 are examples using a liquid agent of a same composition and respectively using inks (inks 1 to 7) of which the pigment solid content amounts were made different from one another. In each of Examples 1-1 to 1-7, 100 μL of the liquid agent (liquid agent 1) indicated in TABLE 3 was permeated into a melamine foam (surface area: 1 $cm^2$, thickness: 5 mm); then the inks 1 to 7 indicated in TABLE 3 were used in Examples 1-1 to 1-7, respectively, so as to perform evaluation of accumulation in the following method. Further, the chromaticness (C*) and the optical density (OD value) of recorded matters obtained by performing recording respectively with the inks 1 to 7 indicated in TABLE 3, the surface tension of the liquid agent (liquid agent 1) indicated in TABLE 3 under the condition that the liquid agent 1 was prepared as an aqueous solution in which concentration of the liquid agent 1 was 5% by weight, and the ratio of average particle diameters of the resin dispersion <Method of Evaluating Accumulation>

An ink-jet recording apparatus "MFC-J6970CDW", manufactured by BROTHER KOGYO KABUSHIKI KAISHA and having the melamine foam as described above arranged therein as a platen foam, was prepared. Each of the inks 1 to 7 used in Examples 1-1 to 1-7 respectively was poured into an empty ink tank and the ink tank was installed in a tank holder of the ink-jet recording apparatus "MFC-J6970CDW"so as to discharge each of the inks 1 to 7 from the ink-jet head of the ink-jet recording apparatus MFC-J6970CDW. After that, the ink-jet recording apparatus was connected to a host computer, a "borderless printing" was selected by a printer driver, and a sample image ISO/JIS-SCID (N3 fruit) was printed continuously on 500 sheets of Glossy Photo Paper "BP71", L size, manufactured by BROTHER KOGYO KABUSHIKI KAISHA. Then, the evaluation of accumulation was performed in accordance with the following evaluation criterion.

[Evaluation Criterion for Accumulation]

A: No accumulation of the resin dispersion type pigment was observed on the melamine foam (platen foam), and no contamination on the back surface of the glossy photo paper was observed in 500 sheets of the glossy photo paper.

B: No accumulation of the resin dispersion type pigment was observed on the melamine foam (platen foam), but contamination on the back surface of the glossy photo paper was observed in not more than 2 sheets among 500 sheets of the glossy photo paper.

B—: Accumulation of the resin dispersion type pigment was observed on the melamine foam (platen foam), and contamination on the back surface of the glossy photo paper was observed in 3 to 49 sheets among 500 sheets of the glossy photo paper.

C: Accumulation of the resin dispersion type pigment was observed on the melamine foam (platen foam), and contamination on the back surface of the glossy photo paper was observed in not less than 50 sheets among 500 sheets of the glossy photo paper.

<Method for Measuring the Chromaticness (C*) of Recorded Matter>

The ink-jet recording apparatus "MFC-J6970CDW" was used to record an image including a single color patch on a plain paper, under the conditions with a resolution of 600 dpi×300 dpi, with each of the inks 1-1 to 1-7 used in Examples 1-1 to 1-7 respectively. Thus, evaluation samples were produced. The chromaticness (C*) of each of the evaluation samples at five locations (five portions) of each of the evaluation samples were measured by using a spectrophotometric colorimetry meter "SpectroEye" manufactured by X-RITE INC., and the average value of the chromaticness (C*) of each of the samples was obtained. As the plain paper, plain paper "XEROX 4200" produced by XEROX CORPORATION was used.

<Method for Measuring the Optical Density (OD Value) of Recorded Matter>

The ink-jet recording apparatus "MFC-J6970CDW" was used to record an image including a single-color patch on the plain paper, under the conditions with a resolution of 600 dpi×300 dpi, duty of 100%, liquid droplet amount of 35 pL, with each of the inks 1 to 7 used in Examples 1-1 to 1-7 respectively. Thus, evaluation samples were produced. The optical densities (OD values) of each of the evaluation samples at three locations (three portions) of each of the evaluation samples were measured by using the spectrophotometric colorimetry meter "SpectroEye" (light source: $D_{50}$, field: 2°, density: ANSI T) manufactured by X-RITE INC., and the average value of the optical densities (OD values) of each of the samples was obtained.

<Method for Measuring the Surface Tension of the Liquid Agent Under the Condition that the Liquid Agent is Prepared as an Aqueous Solution in which Concentration of the Liquid Agent is 5% by Weight>

There was prepared an aqueous solution in which the concentration of the liquid agent (liquid agent 1) used in Examples 1-1 to 1-7 was 5% by weight, and the surface tension of the prepared aqueous solution was measured by using a dynamic surface tension meter "CBVP-Z" (mode name) manufactured by KYOWA INTERFACE SCIENCE, CO., LTD., under a condition of temperature of 25 degrees Celsius.

<Method for Measuring the Ratio of Average Particle Diameters of the Resin Dispersion Type Pigment Between Before and after the Ink Made Contact with Melamine Foam (Y/X)>

In each of Examples 1-1 to 1-7, the resin dispersion type pigment both before and after one of the inks 1 to 7 used in Examples 1-1 to 1-7 made contact with the melamine foam was diluted so that the pigment solid content amount became 0.02% by weight. Then, the average particle diameters of the resin dispersion type pigment before and after one of the inks 1 to 7 used in Examples 1-1 to 1-7 made contact with the melamine foam were calculated by using a dynamic light scattering particle diameter distribution measuring apparatus LB-550 manufactured by HORIBA, Ltd. so as to calculate the average particle diameters before and after the contact, with the intensity of scattered light as the reference for the average particle diameter, based on which the ratio (Y/X) was obtained.

The inks, the liquid agent used in Examples 1-1 to 1-7, the evaluations and the results of measurements are indicated in TABLE 3 as follows.

TABLE 3

| | EXAMPLES | | | | | | |
|---|---|---|---|---|---|---|---|
| | 1-1 | 1-2 | 1-3 | 1-4 | 1-5 | 1-6 | 1-7 |
| INK | 1 | 2 | 3 | 4 | 5 | 6 | 7 |
| (A) Pigment solid content amount (% by weight) | 3.5 | 4.5 | 6.0 | 3.5 | 4.5 | 6.0 | 3.5 |
| Chromaticness C*, yellow) of recorded matter | 78 | 81 | 85 | — | — | — | — |
| Chromaticness (C*, magenta) of recorded matter | — | — | — | 61.9 | 62.3 | 62.8 | — |
| Chromaticness (C*, cyan) of recorded matter | — | — | — | — | — | — | 51.1 |
| Optical density (OD value) of recorded matter | 0.76 | 0.80 | 0.85 | 0.73 | 0.79 | 0.86 | 1.02 |
| LIQUID AGENT | 1 | 1 | 1 | 1 | 1 | 1 | 1 |
| (B) Blending amount of water-soluble organic solvent (% by weight) | 100 | 100 | 100 | 100 | 100 | 100 | 100 |
| Blending amount of surfactant (% by weight) | 2.0 | 2.0 | 2.0 | 2.0 | 2.0 | 2.0 | 2.0 |

TABLE 3-continued

| | EXAMPLES | | | | | | |
|---|---|---|---|---|---|---|---|
| | 1-1 | 1-2 | 1-3 | 1-4 | 1-5 | 1-6 | 1-7 |
| Surface tension of liquid agent under the condition that the liquid agent is prepared as an aqueous solution in which concentration of the liquid agent is 5% by weight (mN/m) | 43 | 43 | 43 | 43 | 43 | 43 | 43 |
| B/A | 28.6 | 22.2 | 16.7 | 28.6 | 22.2 | 16.7 | 28.6 |
| Y/X | 1,0 | 1.0 | 1.0 | 1.0 | 1.0 | 1.0 | 0.9 |
| Evaluation of accumulation | A | A | A | A | A | A | A |

As indicated in TABLE 3, all of Examples 1-1 to 1-7 had quite satisfactory results in the evaluation of accumulation, without depending on the pigment solid content amount. In particular, Examples 1-2, 1-3, 1-5 and 1-6 in which the pigment solid content amount was within the range of 4.5% by weight to 6% by weight could satisfy both of the suppression of accumulation and the high chromaticness (C*) and optical density (OD value) of recorded matter.

Examples 2-1 to 2-8 and Comparative Examples 2-1 and 2-2

Examples 2-1 to 2-8 and Comparative Examples 2-1 and 2-2 are examples each using the ink 2 of which pigment solid content amount was 4.5% by weight and respectively using liquid agents of which the compositions were made different from one another. Examples 2-1 to 2-8 and Comparative Examples 2-1 and 2-2 were subjected to the evaluation of accumulation, the measurement of chromaticness (C*) and optical density (OD value) of recorded matters obtained by performing recording respectively with the ink (Ink 2) indicated in TABLE 4, the measurement of the surface tension of the liquid agents indicated in TABLE 4 under the condition that each of the liquid agents was prepared as an aqueous solution in which concentration of the liquid agent was 5% by weight, and the measurement of the ratio of average particle diameters (Y/X) of the resin dispersion type pigment between before and after the ink (Ink 2) indicated in TABLE 4 made contact with the melamine foam, in a similar manner as with Examples 1-1 to 1-7, except that the ink (Ink 2) and the liquid agents indicated in TABLE 4 were used. The ink, the liquid agents used in Examples 2-1 to 2-8 and Comparative Examples 2-1 and 2-2, the evaluations and the results of measurements are indicated in TABLE 4 as follows. Note that TABLE 4 also indicates the evaluation and measurement results of Example 1-2 as well.

TABLE 4

| | EXAMPLES | | | | | | | | | COMPARATIVE EXAMPLES | |
|---|---|---|---|---|---|---|---|---|---|---|---|
| | 1-2 | 2-1 | 2-2 | 2-3 | 2-4 | 2-5 | 2-6 | 2-7 | 2-8 | 2-1 | 2-2 |
| INK | 2 | 2 | 2 | 2 | 2 | 2 | 2 | 2 | 2 | 2 | 2 |
| (A) Pigment solid content amount (% by weight) | 4.5 | 4.5 | 4.5 | 4.5 | 4.5 | 4.5 | 4.5 | 4.5 | 4.5 | 4.5 | 4.5 |
| Chromaticness (C*, yellow) of recorded matter | 81 | 81 | 81 | 81 | 81 | 81 | 81 | 81 | 81 | 81 | 81 |
| Optical density (OD value) of recorded matter | 0.80 | 0.80 | 0.80 | 0.80 | 0.80 | 0.80 | 0.80 | 0.80 | 0.80 | 0.80 | 0.80 |
| LIQUID AGENT | 1 | 3 | 4 | 5 | 6 | 7 | 10 | 11 | 17 | 2 | 9 |
| (B) Blending amount of water-soluble organic solvent (% by weight) | 100 | 35.0 | 35.0 | 35.0 | 35.0 | 35.0 | 45.0 | 50.0 | 35.0 | 35.0 | 30.0 |
| Blending amount of surfactant (% by weight) | 2.0 | 0.5 | 1.0 | 2.0 | 22.0 | 25.0 | 2.0 | 2.0 | 2.0 | — | 2.0 |
| Surface tension of liquid agent under the condition that the liquid agent is prepared as an aqueous solution in which concentration of the liquid agent is 5% by weight (mN/m) | 43 | 49 | 45 | 44 | 30 | 29 | 44 | 44 | 37 | 66 | 44 |
| B/A | 22.2 | 7.8 | 7.8 | 7.8 | 7.8 | 7.8 | 10.0 | 11.1 | 7.8 | 7.8 | 6.7 |
| Y/X | 1.0 | 1.0 | 1.0 | 1.0 | 1.3 | 1.7 | 1.0 | 1.0 | 1.1 | 1.0 | 1.0 |
| Evaluation of accumulation | A | B | B | B | B | B- | B | A | B | C | C |

As indicated in TABLE 4, all of Examples 1-2 and Examples 2-1 to 2-8 had satisfactory results in the evaluation of accumulation. In particular, Examples 1-2, 2-1 to 2-4 and 2-6 to 2-8, in each of which the blending amount of surfactant in the liquid agent was in a range of 0.5% by weight to 22% by weight and in each of which the surface tension of the liquid agent under the condition that the liquid agent is prepared as an aqueous solution in which concentration of the liquid agent is 5% by weight was in a range of 30 mN/m to 50 mN/m, had further satisfactory results in the evaluation of accumulation and also the value of the ratio (Y/X) was within a range of 0.9 to 1.3. Further, Examples 1-2 and 2-7, in each of which the blending amount (B) of water-soluble organic solvent in the liquid agent was not less than 11 times the blending amount (A) of resin dispersion type pigment in the ink, had quite satisfactory results in the evaluation of accumulation. Furthermore, Example 2-5 had the result of evaluation of accumulation that was "-B", which was relatively less satisfactory to some extent as compared with the other examples. The reason for this result for Example 2-5 is not clear, but is presumed as follows. Namely, the surfactant has a high viscosity in the water-soluble organic solvent. The liquid agent inside the melamine foam (absorber) has the effect of allowing the particles of the resin dispersion type pigment to permeate into the melamine foam without causing the particles of the resin dispersion type pigment to aggregate. However, in a case that the blending amount of the surfactant in the liquid agent is great, the viscosity of the liquid agent is increased, which in turn is presumed to suppress this effect of the liquid agent. Accordingly, Examples 2-5 in which the blending amount of the surfactant in the liquid agent was relatively large is presumed to have a relatively less satisfactory result to some extent in the evaluation of accumulation as compared with the other examples.

On the other hand, Comparative Example 2-1 wherein the surface tension of the liquid agent under the condition that the liquid agent is prepared as the aqueous solution in which concentration of the liquid agent is 5% by weight was 66 mN/m, and Comparative Example 2-2 in which the blending amount (B) of water-soluble organic solvent in the liquid agent was 6.7 times the blending amount (A) of resin dispersion type pigment in the ink, each had unsatisfactory result in the evaluation of accumulation.

Examples 3-1 and 3-2

Examples 3-1 and 3-2 are examples each using the ink 1 or ink 7 of which pigment solid content amount was 3.5% by weight and each using a liquid agent of which composition was made different from that used in Examples 1-1 and 1-7 using Ink 1 and Ink 7 respectively. Examples 3-1 and 3-2 were subjected to the evaluation of accumulation, the measurement of chromaticness (C*) and optical density (OD value) of recorded matters obtained by performing recording respectively with the ink (Ink 1 or Ink 7) indicated in TABLE 5, the measurement of the surface tension of the liquid agent (Liquid Agent 8) indicated in TABLE 5 under the condition that the liquid agent (Liquid Agent 8) was prepared as an aqueous solution in which concentration of the liquid agent was 5% by weight, and the measurement of the ratio of average particle diameters (Y/X) between before and after the ink (Ink 1 or Ink 7) indicated in TABLE 5 made contact with the melamine foam, in a similar manner as with Examples 1-1 to 1-7, except that the liquid agent (Liquid Agent 8) indicated in TABLE 5 was used. The inks, the liquid agent used in Examples 3-1 and 3-2, the evaluations and the results of measurements are indicated in TABLE 5 as follows. Note that TABLE 5 also indicates the evaluations and measurement results of Examples 1-1 and 1-7 as well.

TABLE 5

| | EXAMPLES | | | |
|---|---|---|---|---|
| | 1-1 | 1-7 | 3-1 | 3-2 |
| INK | 1 | 7 | 1 | 7 |
| (A) Pigment solid content amount (% by weight) | 3.5 | 3.5 | 3.5 | 3.5 |
| Chromaticness (C*, yellow) of recorded matter | 78 | — | 78 | — |
| Chromaticness (C*, cyan) of recorded matter | — | 51.1 | — | 51.1 |
| Optical density (OD value) of recorded matter | 0.76 | 1.02 | 0.76 | 1.02 |
| LIQUID AGENT | 1 | 1 | 8 | 8 |
| (B) Blending amount of water-soluble organic solvent (% by weight) | 100 | 100 | 25.0 | 25.0 |
| Blending amount of surfactant (% by weight) | 2.0 | 2.0 | 2.0 | 2.0 |
| Surface tension of liquid agent under the condition that the liquid agent is prepared as an aqueous solution in which concentration of the liquid agent is 5% by weight (mN/m) | 43 | 43 | 44 | 44 |
| B/A | 28.6 | 28.6 | 7.1 | 7.1 |
| Y/X | 1.0 | 0.9 | 1.0 | 1.0 |
| Evaluation of accumulation | A | A | B | B |

As indicated in TABLE 5, all of Examples 1-1, 1-7, 3-1 and 3-2 had satisfactory results in the evaluation of accumulation. In particular, Example 1-1 and 1-7, in each of which the blending amount (B) of water-soluble organic solvent in the liquid agent was 28.6 times the blending amount (A) of resin dispersion type pigment in the ink, had quite satisfactory results in the evaluation of accumulation.

Examples 4-1 to 4-8 and Comparative Examples 4-1 to 4-3

Examples 1-4 to 4-8 and Comparative Examples 4-1 to 4-3 are examples each using the ink 3 or ink 6 of which pigment solid content amount was 6.0% by weight and respectively using liquid agents of which the compositions were made different from one another. Examples 1-4 to 4-8 and Comparative Examples 4-1 to 4-3 were subjected to the evaluation of accumulation, the measurement of chromaticness (C*) and optical density (OD value) of recorded matters obtained by performing recording respectively with the ink (Ink 3 or Ink 6) indicated in TABLE 6, the measurement of the surface tension of the liquid agents indicated in TABLE 6 under the condition that each of the liquid agents was prepared as an aqueous solution in which concentration of the liquid agent was 5% by weight, and the measurement of the ratio of average particle diameters (Y/X) of the resin dispersion type pigment between before and after the ink (Ink 3 or Ink 6) indicated in TABLE 6 made contact with the melamine foam, in a similar manner as with Examples 1-3 and 1-6, except that the ink (Ink 3 or Ink 6) and the liquid agents indicated in TABLE 6 were used. The inks, the liquid agents used in Examples 4-1 to 4-8 and Comparative Examples 4-1 to 4-3, the evaluations and the results of measurements are indicated in TABLE 6 as follows. Note that TABLE 6 also indicates the evaluations and measurement results of Examples 1-3 and 1-6 as well.

TABLE 6

| | EXAMPLES | | | | | | | | | | COMPARATIVE EXAMPLES | | |
|---|---|---|---|---|---|---|---|---|---|---|---|---|---|
| | 1-3 | 1-6 | 4-1 | 4-2 | 4-3 | 4-4 | 4-5 | 4-6 | 4-7 | 4-8 | 4-1 | 4-2 | 4-3 |
| INK | 3 | 6 | 3 | 3 | 3 | 3 | 3 | 6 | 6 | 6 | 3 | 3 | 6 |
| (A) Pigment solid content amount (% by weight) | 6.0 | 6.0 | 6.0 | 6.0 | 6.0 | 6.0 | 6.0 | 6.0 | 6.0 | 6.0 | 6.0 | 6.0 | 6.0 |
| Chromaticness (C*, yellow) of recorded matter | 85 | — | 85 | 85 | 85 | 85 | 85 | — | — | — | 85 | 85 | — |
| Chromaticness (C*, magenta of recorded matter | — | 62.8 | — | — | — | — | — | 62.8 | 62.8 | 62.8 | — | — | 62.8 |
| Optical density (OD value) of recorded matter | 0.85 | 0.86 | 0.85 | 0.85 | 0.85 | 0.85 | 0.85 | 0.86 | 0.86 | 0.86 | 0.85 | 0.85 | 0.86 |
| LIQUID AGENT | 1 | 1 | 10 | 13 | 14 | 15 | 16 | 10 | 13 | 14 | 12 | 18 | 18 |
| (B) Blending amount of water-soluble organic solvent (% by weight) | 100 | 100 | 45.0 | 65.0 | 70.0 | 100 | 45.0 | 45.0 | 65.0 | 70.0 | 40.0 | 45.0 | 45.0 |
| Blending amount of surfactant (% by weight) | 2.0 | 2.0 | 2.0 | 2.0 | 2.0 | 2.0 | 2.0 | 2.0 | 2.0 | 2.0 | 2.0 | — | — |
| Surface tension of liquid agent under the condition that the liquid agent is prepared as an aqueous solution in which concentration of the liquid agent is 5% by weight (mN/m) | 43 | 43 | 44 | 43 | 43 | 43 | 43 | 44 | 43 | 43 | 44 | 68 | 68 |
| B/A | 16.7 | 16.7 | 7.5 | 10.8 | 11.7 | 16.7 | 7.5 | 7.5 | 10.8 | 11.7 | 6.7 | 7.5 | 7.5 |
| Y/X | 1.0 | 1.0 | 1.0 | 1.0 | 1.0 | 1.0 | 1.0 | 1.0 | 1.0 | 1.0 | 1.0 | 1.0 | 1.0 |
| Evaluation of accumulation | A | A | B | B | A | A | B | B | B | A | C | C | C |

As indicated in TABLE 6, all of Examples 1-3, 1-6 and Examples 4-1 to 4-8 had satisfactory results in the evaluation of accumulation. In particular, Examples 1-3, 1-6, 4-3, 4-4 and 4-8, in each of which the blending amount (B) of water-soluble organic solvent in the liquid agent was not less than 11 times the blending amount (A) of resin dispersion type pigment in the ink, had quite satisfactory results in the evaluation of accumulation. On the other hand, Comparative Example 4-1 in which the blending amount (B) of water-soluble organic solvent in the liquid agent was 6.7 times the blending amount (A) of resin dispersion type pigment in the ink and Comparative Examples 4-2 and 4-3 in each of which the surface tension of the liquid agent under the condition that the liquid agent is prepared as the aqueous solution in which concentration of the liquid agent is 5% by weight was 68 mN/m each had unsatisfactory result in the evaluation of accumulation.

As described above, the ink-jet recording apparatus of the present teaching is capable of further suppressing the accumulation of colorant in the surface of the absorber. The usage of the ink-jet recording apparatus of the present teaching is not particularly limited, and is widely applicable to a variety of kinds of ink-jet recording.

What is claimed is:

1. An ink-jet recording apparatus comprising:

an ink containing a resin dispersion type pigment;

an ink-jet head configured to discharge the ink;

an absorber which is arranged in an area facing a discharge surface of the ink-jet head, and which is configured to absorb the ink discharged from the ink-jet head; and a liquid agent which contains a water-soluble organic solvent, and which is absorbed in the absorber, wherein a surface tension of an aqueous solution containing the liquid agent at concentration of 5% by weight is not more than 50 mN/m;

a blending percentage by weight of the water-soluble organic solvent in the liquid agent is not less than seven times a blending percentage by weight of the resin dispersion type pigment in the ink, wherein the absorber is at least one of a flushing foam and a platen foam; and the ink-jet recording apparatus satisfies the following condition (a):

$$0.9 \leq Y/X \leq 1.3 \quad \text{(a):}$$

wherein:

X: average particle diameter (nm) of the resin dispersion type pigment before the ink makes contact with the absorber; and Y: average particle diameter (nm) of the resin dispersion type pigment after the ink has made contact with the absorber.

2. The ink-jet recording apparatus according to claim 1, wherein the blending amount of the resin dispersion type pigment in the ink is in a range of 4.5% by weight to 6% by weight.

3. The ink-jet recording apparatus according to claim 1, wherein the surface tension of the aqueous solution containing the liquid agent at the concentration of 5% by weight is not less than 30 mN/m.

4. The ink-jet recording apparatus according to claim 1, wherein the blending percentage by weight of the water-soluble organic solvent in the liquid agent is not less than eleven times the blending percentage by weight of the resin dispersion type pigment in the ink.

5. The ink-jet recording apparatus according to claim 1, wherein the blending percentage by weight of the water-soluble organic solvent in the liquid agent is not more than 30 times the blending percentage by weight of the resin dispersion type pigment in the ink.

6. The ink-jet recording apparatus according to claim 1, wherein the blending amount of the resin dispersion type pigment in the ink is in a range of 4.5% by weight to 6% by weight; and the blending percentage by weight of the water-soluble organic solvent in the liquid agent is not more than 23 times the blending percentage by weight of the resin dispersion type pigment in the ink.

7. The ink-jet recording apparatus according to claim 1, wherein the water-soluble organic solvent contains a surfactant; and a blending amount of the surfactant in the liquid agent is in a range of 0.5% by weight to 22% by weight.

8. The ink-jet recording apparatus according to claim 7, wherein the water-soluble organic solvent contains the surfactant, and one selected from the group consisting of: alkylene glycol and alkylene glycol ether.

9. The ink-jet recording apparatus according to claim 7, wherein the water-soluble organic solvent contains an acetylene glycol-based nonionic surfactant, and one selected from the group consisting of: triethylene glycol, diethylene glycol, tripropylene glycol and triethylene glycol-n-butyl ether.

10. The ink-jet recording apparatus according to claim 1, wherein the water-soluble organic solvent contains a surfactant; and ratio of the surfactant in the water-soluble organic solvent is in a range of 1% by weight to 72% by weight.

11. The ink-jet recording apparatus according to claim 1, wherein the absorber is at least one of a flushing foam and a platen foam.

12. The ink-jet recording apparatus according to claim 1, wherein an amount of the liquid agent contained in the absorber is in a range of 0.10 $\mu g/mm^3$ to 0.91 $\mu g/mm^3$.

13. The ink-jet recording apparatus according to claim 1, wherein the absorber is at least one of a flushing foam and a platen foam; and an amount of the water-soluble organic solvent contained in the absorber is in a range of 0.10 g to 0.81 g.

14. The ink-jet recording apparatus according to claim 1, wherein the liquid agent is charged into the ink-jet head and an ink flow channel of the ink-jet recording apparatus at a time of shipment of the ink-jet recording apparatus from a factory; and at a time of introduction of the ink into the ink-jet head and the ink flow channel, the liquid agent is discharged onto the absorber from the ink-jet head and thereby the liquid agent is absorbed in the absorber.

15. The ink-jet recording apparatus according to claim 1, wherein the liquid agent is absorbed in the absorber at a time of shipment of the ink-jet recording apparatus from a factory.

16. An accumulation suppressing method for suppressing accumulation of a resin dispersion type pigment in a surface of an absorber in an ink-jet recording apparatus including: an ink-jet head configured to discharge an ink containing the resin dispersion type pigment; and the absorber which is configured to absorb the ink, the method comprising:

discharging the ink from the ink-jet head; and absorbing the ink, discharged from the ink-jet head, with the absorber which is arranged in an area facing a discharge surface of the ink-jet head, and which contains a liquid agent containing a water-soluble organic solvent, wherein a surface tension of an aqueous solution containing the liquid agent at concentration of 5% by weight is not more than 50 mN/m;

a blending percentage by weight of the water-soluble organic solvent in the liquid agent is not less than seven times a blending percentage by weight of the resin dispersion type pigment in the ink, wherein the absorber is at least one of a flushing foam and a platen foam; and the ink-jet recording apparatus satisfies the following condition (a):

$$0.9 \leq Y/X \leq 1.3 \quad \text{(a):}$$

wherein:

X: average particle diameter (nm) of the resin dispersion type pigment before the ink makes contact with the absorber; and Y: average particle diameter (nm) of the resin dispersion type pigment after the ink has made contact with the absorber.

* * * * *